US005725029A

United States Patent [19]

Loehr et al.

[11] Patent Number: 5,725,029

[45] Date of Patent: Mar. 10, 1998

[54] TENSION CONTROL APPARATUS FOR WEFT THREADS

[75] Inventors: Heinz-Peter Loehr, Maria-Thann; Rainer Schuster, Lindau, both of Germany

[73] Assignee: Lindauer Dornier Gesellschaft mbH, Lindau, Germany

[21] Appl. No.: 710,524

[22] Filed: Sep. 18, 1996

[30] Foreign Application Priority Data

Sep. 27, 1995 [DE] Germany ..... 195 35 895.3

[51] Int. Cl.[6] ..... D03D 47/38; D03D 47/34; D03D 51/34

[52] U.S. Cl. ..... 139/453; 139/194; 139/430; 139/450

[58] Field of Search ..... 139/453, 450, 139/194, 430

[56] References Cited

U.S. PATENT DOCUMENTS

| | | | |
|---|---|---|---|
| 5,477,892 | 12/1995 | Corain et al. | 139/453 |
| 5,544,679 | 8/1996 | Tacq | 139/453 |

FOREIGN PATENT DOCUMENTS

| | | |
|---|---|---|
| 0333302 | 9/1989 | European Pat. Off. . |
| 0357975 | 2/1995 | European Pat. Off. . |
| 2447416 | 8/1980 | France . |
| 2212907 | 10/1972 | Germany . |
| 550879 | 6/1974 | Switzerland . |

OTHER PUBLICATIONS

Article by b. Wulfhorst and F. Lehnert "Reduzierung der Schussfaden–belastung mit Hilfe einer neuentwickelten geregelten Schussfadenbremse" (Reducing the Weft Thread Loading by Means of a Newly Developed COntrolled Weft Thread Brake), Special Publication Print by Textil Praxis International (1991) 12, pp. 1291 to 1298. No translation.

*Primary Examiner*—Andy Falik
*Attorney, Agent, or Firm*—W. G. Fasse; W. F. Fasse

[57] ABSTRACT

An apparatus for reducing the load on a weft thread being inserted into a loom shed reduces the necessary number of weft thread monitors or stop motion devices functioning as thread tension sensors while still ensuring a reliable tension measurement, especially in a gripper loom in which a plurality of different weft thread types are to be respectively inserted into the loom shed using a weft thread selector and insertion arrangement. A single first thread tension sensor (14) is provided to be common to all of the weft thread types (6) that are to be inserted. The sensor (14) is arranged in a first arrangement plane at a location downstream of the weft thread selector and change arrangement (8). A single second thread tension sensor (19) is arranged in a second arrangement plane at a location between the first thread tension sensor (14) and the weft thread selector and change arrangement (8). Thus, only two thread tension sensors are used, in series, for the total of all weft thread types that are to be inserted into the loom shed, and therefore all the tension values are directly comparable with one another.

20 Claims, 2 Drawing Sheets

TENSION CONTROL APPARATUS FOR WEFT THREADS

FIELD OF THE INVENTION

The invention relates to an apparatus for controlling, or especially reducing, the tension load on a weft thread to be inserted into the shed of a loom. The applicable loom is especially a gripper loom having weft thread storage and supply devices for a plurality of different weft thread types, a plurality of weft thread brakes with associated actuators arranged after or downstream of the weft thread storage and supply devices in a direction toward the loom shed, thread tension sensors for sensing or measuring the weft thread tension, an electronic control unit that forms a control loop together with each weft thread brake and the tension sensors, and a weft thread selecting and changing arrangement for selecting a respective one of the plural types of weft threads according to a fabric pattern and presenting the selected thread to a weft thread insertion member. The insertion member may, for example, be a gripper and a rapier that is guided by means external to the loom shed.

BACKGROUND INFORMATION

It is known from published European Patent Specification 0,357,975 to provide an arrangement for controlling or regulating the tension of weft threads in a loom for weaving with respective selected ones of plural weft thread types. The known arrangement includes a respective weft thread brake associated with each weft thread type that is to be inserted into the loom shed. The known arrangement further includes a respective weft thread monitor or stop motion device, which acts as a tension sensor, respectively arranged after or downstream of each weft brake. Each tension sensor is connected to an electronic interface or control circuit, in which tension reference values are compared with the tension actual values that are determined by each tension sensor, for example during the insertion period. When the tension actual value deviates from the tension reference value, a signal for varying the braking force is provided to the respective corresponding weft thread brake.

A disadvantage of the known arrangement is that it necessarily must provide a respective weft thread monitor or stop motion device functioning as a thread tension sensor, for each one of the plurality of weft threads, between the respective brake and the weft thread selecting and insertion arrangement. Thus, the number of successively insertable weft thread types is strictly dependent upon, or limited to, the number of weft thread stop motion devices that have been provided in the arrangement. This limitation is technically and economically undesirable, for example, because it limits the fabrics that can be produced on the loom, it requires an increased number and complexity of components, and it requires re-equipping of the loom for different fabrics.

OBJECTS OF THE INVENTION

In view of the above it is the aim of the invention to achieve the following objects singly or in combination:

- to provide an arrangement that can influence the tension of the respective weft thread during the weft insertion in such a manner that both tension peaks and also tension troughs or minima can be substantially avoided;
- to provide an arrangement of the above described type in which the number of weft thread monitors or stop motion devices employed as tension sensors can be minimized, totally independent of the number of weft threads that are to be inserted as required by any particular fabric pattern, while still assuring a reliably functioning tension measurement based on the thread tension force;
- to reduce the cost and complexity, and the flexibility of use, of such an arrangement for controlling the weft thread tension;
- to provide such an arrangement in which at least a first tension sensor continually senses the progression of the thread tension force during the entire weft thread insertion period or over a particular rotational angle of the loom main shaft, and in which at least a second tension sensor senses the progression of the tension force during the presentation of the weft thread from the weft thread selector arrangement to the insertion member;
- to provide such an arrangement in which only two thread tension sensors are required for the total number of weft thread types to be inserted into the loom shed, and each of the sensors senses a particular type of tension value for each of the plural threads, so that all tension values can be directly compared among one another; and
- to provide such an arrangement in which thread tension sensors are arranged in different orientation planes.

SUMMARY OF THE INVENTION

The above objects have been achieved in an apparatus for controlling the tension of a weft thread, generally in the field as described above, but especially embodied according to the invention. Accordingly, for the plurality of weft thread types that are to be inserted into the loom shed according to a fabric pattern, the apparatus includes only a single weft thread monitor or stop motion device effective as a thread tension sensor arranged in a first arrangement plane between the weft thread selecting and changing arrangement and the inlet or entrance to the loom shed. The weft thread to be inserted is necessarily brought into contact with the thread tension sensor in this first arrangement plane, during the thread insertion period or in relation to the rotational angle of the loom main shaft, due to the positive carrying of the weft thread by the weft thread insertion member. As a result of this positive contact of the weft thread on the thread sensor, the progression of the thread tension is continuously sensed during the insertion of the weft thread. This progression of the tension force is primarily determined by the dynamics of the weaving cycle, and has an absolute magnitude that is dependent upon the braking force that has been adjusted or selected in the weft thread brakes arranged before or upstream of the sensor.

The invention further provides that it is possible to arrange a second thread tension sensor in a second arrangement plane at a location between the weft thread selection and changing arrangement and the first tension sensor. In this arrangement, on the one hand the weft thread is brought into contact with the first tension sensor during the insertion due to the positive carrying of the weft thread by the insertion member as described above, and on the other hand the weft thread is brought into contact with the second thread tension sensor while the selected thread is being presented from the weft thread selection and changing arrangement to the weft thread insertion member. In this context, the second tension sensor does not sense the progression of the thread tension force during the insertion period or during a certain rotational angle of the main shaft, but rather senses the progression of the tension force during the course of presentation of the weft thread to the insertion member. In this manner it is assured that the progression of the thread tension force is also sensed in the thread between the respective thread brake and the selecting arrangement during the thread presentation process, and accordingly appropriate reactions can be initiated upon the occurrence of any tension maxima or minima.

The arrangement according to the invention has the advantage in comparison to the state of the art, that only two thread tension sensors are required for the total of all of the weft thread types that are to be inserted into the loom shed, i.e. regardless of the total number of different weft thread types, and that each sensor mentions a tension for all of the thread types. Therefore, all of the tension values can be directly compared among one another without calibration or normalization problems.

Another advantage is that all of the thread brakes can be adjusted or balanced among one another by means of the two sensors. Furthermore, the braking force at each weft thread brake can be controlled using principally only the first thread tension sensor, if the tension peak during acceleration of each weft thread is determined through a calculation or computation process from the progression of the thread tension during a first weft thread insertion. Still another advantage of the arrangement according to the invention is that the first weft thread tension sensor arranged in the first arrangement plane is simultaneously effective as a weft thread monitor or stop motion device, because it can monitor the tension of the weft thread over the entire insertion width of the loom shed. Thus, the loss of tension or failure of a signal can be evaluated as indicating a weft thread fault or break.

BRIEF DESCRIPTION OF THE DRAWINGS

In order that the invention may be clearly understood, it will now be described, by way of example, with reference to the accompanying drawings, wherein.

DETAILED DESCRIPTION OF PREFERRED EXAMPLE EMBODIMENTS AND OF THE BEST MODE OF THE INVENTION

Figure 1:
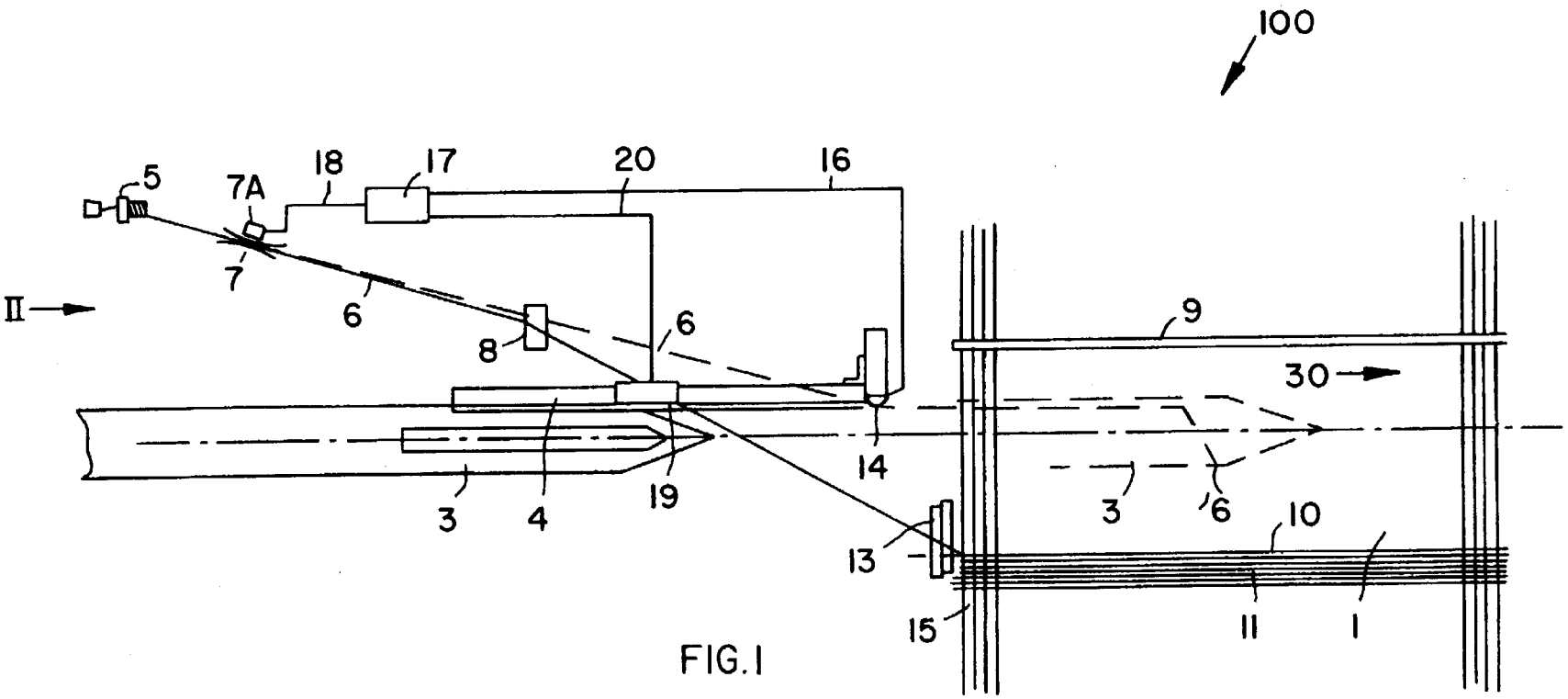
FIG. 1 is a schematic top view of the arrangement according to the invention in a loom, with the two thread tenison sensors arranged in the area of the gripper guides.
Figure 2:
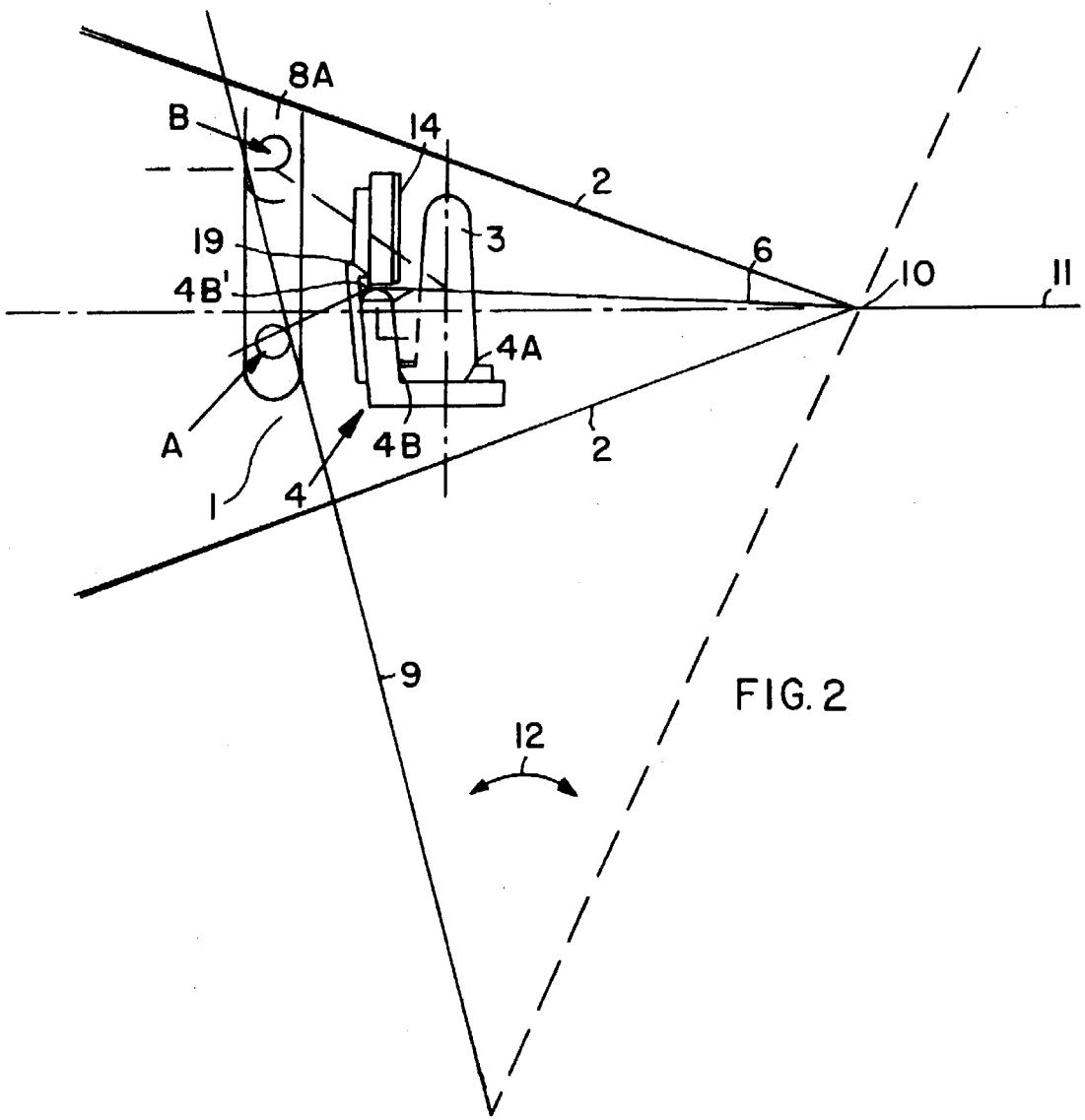
FIG. 2 is a schematic side view of the arrangement in the direction of view arrow II in FIG. 1.

As shown in FIGS. 1 and 2, a weft thread insertion member 3 with a thread gripper, such as a rapier insertion member, is carried by a guide member 4 outside of a loom shed 1 formed by warp threads 2, in a loom 100 in such a manner that the insertion member 3 can alternatingly be moved into and out of the loom shed 1. As shown especially in FIG. 2, the guide member 4 is generally embodied in the form of an angle-profile member and has an inner base plane surface 4A and an inner side or lateral guide surface 4B for contacting and guiding the insertion member 3.

A weft thread 6 that is to be inserted into the loom shed 1 is provided from a weft thread storage and supply device 5, and passes through a weft thread brake 7 with an associated actuator 7A and then through a weft thread selector and change arrangement 8 including a reaching or presenting needle 8A, which presents the weft thread 6 to the insertion member 3. For clarity only one device 5 and one brake 7 are shown. The weft thread 6 is held by a thread clamp, which is not shown, until the weft thread has been received and gripped by the insertion member 3. The thread presenting needle 8A shown in FIG. 2 is merely one of a plurality of such needles of the weft thread selector and changing arrangement 8, which carries out the selection and changeover among a plurality of available weft thread types.

The insertion member 3 inserts the weft thread 6 into the loom shed 1, and then the inserted weft thread 6 is beat-up against the binding point 10 of the woven web 11 by the weaving reed 9 carrying out a rocking or tilting beat-up motion as shown by the double-headed arced arrow 12, in order to form the woven web 11. The weft thread 6 is cut-off by a thread cutter or scissors device 13 arranged near the edge of the woven web, at the beginning of the next insertion cycle of the same thread.

A first thread tension sensor 14 is arranged in a first arrangement plane on the gripper guide member 4 at a location between the loom shed 1, or a catch selvage 15 of the woven web 11 on the one hand, and the weft thread selector and change arrangement 8, or more particularly the thread presenting needle 8A thereof, on the other hand. As can be seen in the two views of FIG. 1 and FIG. 2, the first arrangement plane, i.e. the plane of the sensor 14, is an essentially vertical plane. More particularly, the sensor 14 extends substantially along an essentially vertical line within the vertical first arrangement plane. With this arrangement of the sensor 14, each weft thread 6 is brought into contact with the sensor 14 during the period of insertion of the thread 6, i.e. the time period from when the presenting needle 8A has reached the lower position until the insertion member 3 has gripped the thread 6 and transported it outside the range of sensor 14. Thereby, the sensor 14 senses or measures the thread tension force prevailing in the weft thread 6 between the weft thread brake 7 and the insertion member 3, preferably on a continuous basis.

The sensor 14 provides an appropriate electrical signal corresponding to the sensed tension through a conductor 16 to an electronic control and comparison unit 17. A desired, nominal or reference tension value has been previously provided to the control and comparison unit 17. If the electronic comparison circuit in the unit 17 determines a deviation of the actual tension value provided as a signal by the sensor 14 from the reference tension value, then the unit 17 releases an appropriate electrical signal through a conductor 18 to the actuator 7A of the weft thread brake 7 in order to properly control the braking force applied onto the thread by the weft brake 7.

A second thread tension sensor 19 is provided in a second arrangement plane on the guide member 4, and more particularly in a location between the first thread tension sensor 14 and the weft thread selector and change arrangement 8. As can be seen in FIGS. 1 and 2, the plane of the second sensor 19, i.e. the second arrangement plane, is substantially horizontal. More particularly, the second sensor 19 extends essentially along a horizontal line or a linear direction substantially parallel to the insertion direction shown by the arrow 30. Thus, the first arrangement plane and the second arrangement plane are substantially perpendicular to one another, and the linear orientation of the first sensor 14 and the linear orientation of the second sensor 19 are substantially perpendicular to one another.

With such an arrangement, the respective weft thread 6 being presented by the thread presenting needle 8A is at least temporarily deflected over the upper edge 4B' of the side or lateral guide surface 4B of the guide member 4, as especially shown in FIG. 2, when the thread presenting needle 8A carrying the weft thread is in the position A. In this context, the second sensor 19 is positioned to cover the entire region of the temporary deflection of each of the weft threads 6 over the area of the upper edge 4B' of the lateral guide surface 4B. Due to the above described deflection of each weft thread 6, the thread tension force on the weft thread 6 during the process of thread presentation can be detected or sensed over a certain angular range of the loom main shaft, because the weft thread 6 contacts the sensor 19 and is not being moved. Moreover, the sensor 19 can sense and measure the tension force resulting in the weft thread 6 due to its acceleration when the insertion member 3 has received and gripped the weft thread 6. The thread tension forces sensed by the second sensor 19 are provided as corresponding electrical signals over a conductor 20 to the control and comparison unit 17.

Referring particularly to FIG. 2, after the presenting needle 8A has presented the weft thread 6 to the insertion member 3 in the position A, the presenting needle 8A is moved up into position B. Thereby, the weft thread 6 is removed from, and no longer contacts, the sensor 19. However, once the insertion member 3 moves into the loom shed 1, after a time lag, the weft thread 6 will be brought into contact with the first sensor 14 and then deflected over the sensor 14. The thread 6 will then remain in contact with the sensor 14 throughout the entire weft thread insertion, until the insertion is completed and the weaving reed 9 beats-up the weft thread 6 and thereby pulls or moves the thread 6 away from the sensor 14. It should be understood that the arrangement of sensors shown in FIGS. 1 and 2 is only one possible example embodiment, and the respective duration of contact of the weft thread 6 on the second sensor 19 and the first sensor 14, and any time lag between such periods of contact, can be adjusted as desired by varying the respective size and position of the two sensors.

The principal progression of the weft thread tension during the insertion of the weft thread is generally known, for example as described by B. Wulfhorst and F. Lehnert in "Reduzierung der SchuBfadenbelastung mit Hilfe einer neuentwickelten geregelten SchuBfadenbremse (Reducing the Weft Thread Loading by Means of a Newly Developed Controlled Weft Thread Brake)", Special Publication Print by Textil Praxis international (1991) 12, pages 1291 to 1298. This progression of the thread tension can be expanded or compressed in time dependent on the weaving width or the rotational speed (r.p.m.) of the loom.

In order to reduce tension peaks during the insertion of the weft thread by appropriately controlling the braking force, the above described arrangement according to the invention is operated as follows. First, the braking force of each weft thread brake 7 is programmed or pre-adjusted to an average value or to a particular value defined for a particular respective type of weft thread being used. The tension measuring sensors 14 and 19 can then determine the actually arising tension value, and if need be, trigger an appropriate correction through the control and comparison unit 17 as described above. The successive measurements of the thread tension force are then compared to the value that has been predefined in this manner.

Secondly, the progression of the thread tension force is continuously measured during the first insertion of a weft thread, during the time period of the insertion or over a predetermined rotational angular range of the loom main shaft.

Thirdly, the determination of the minimal and maximal values of the thread tension force relative to the rotational angle of the loom main shaft, or relative to the insertion time period, are used to determine the nominal braking force of the thread brake 7 for the future weft thread insertions using the same weft thread. The actual tension values measured during each insertion using a particular weft thread can then be used to update or fine tune the determined nominal braking force for the successive future weft thread insertions.

The above described process serves to optimize the progression of the braking force during a weft insertion cycle, especially in a gripper loom, particularly so that tension peaks and tension minima can be minimized or avoided.

Although the invention has been described with reference to specific example embodiments, it will be appreciated that it is intended to cover all modifications and equivalents within the scope of the appended claims.

What is claimed is:

1. In a loom having a weft thread selector arrangement adapted to receive a plurality of different weft threads and to respectively select from said plurality of threads and present a single selected weft thread that is to be inserted into a loom shed of the loom, an improved thread tension control apparatus comprising a plurality of weft thread brakes respectively arranged thread-flow-upstream from said weft thread selector arrangement to receive respective ones of the plurality of weft threads running through said brakes, a first thread tension sensor arranged on a first plane thread-flow-downstream from said weft thread selector arrangement to sense a tension of the selected weft thread, and a control loop arranged to connect said first thread tension sensor to said brakes.

2. The thread tension control apparatus in the loom of claim 1, further comprising a second thread tension sensor arranged on a second plane between said weft thread selector arrangement and said first thread tension sensor, wherein said control loop is further arranged to connect said second thread tension sensor to said brakes.

3. The thread tension control apparatus in the loom of claim 2, wherein said first sensor extends in a first linear direction along said first plane, said second sensor extends in a second linear direction along said second plane, and said first and second planes are substantially perpendicular to each other.

4. The thread tension control apparatus in the loom of claim 3, wherein said first plane is substantially vertical and said second plane is substantially horizontal.

5. The thread tension control apparatus in the loom of claim 3, wherein said first and second linear directions are substantially perpendicular to each other.

6. The thread tension control apparatus in the loom of claim 5, wherein said first linear direction is substantially vertical, and said second linear direction is substantially horizontal and parallel to a weft insertion direction.

7. The thread tension control apparatus in the loom of claim 2, wherein said first and second sensors are spaced apart from one another with a gap therebetween.

8. The thread tension control apparatus in the loom of claim 2, having only one said first sensor and only one said second sensor and having no other weft thread tension sensor regardless of the number of said plurality of weft threads.

9. The thread tension control apparatus in the loom of claim 2, wherein the loom is a gripper loom further having a gripper-type weft thread insertion member arranged to receive the selected weft thread presented by said weft thread selector arrangement, and a guide member arranged externally from said loom shed in guiding contact with said insertion member, and wherein said first sensor and said second sensor are mounted on said guide member.

10. The thread tension control apparatus in the loom of claim 9, wherein said first sensor is mounted on and extends upwardly from an end of said guide member closest to said loom shed, and said second sensor is mounted on and extends along an upper edge of said guide member.

11. The thread tension control apparatus in the loom of claim 2, wherein said control loop comprises an electronic control and comparison unit, a first conductor connecting a signal output of said first sensor to said unit, a second conductor connecting a signal output of said second sensor to said unit, and respective third conductors connecting said unit respectively to said weft thread brakes.

12. The thread tension control apparatus in the loom of claim 2, wherein the loom further includes a respective plurality of weft thread storage and supply devices to provide the plurality of weft threads, and wherein said weft thread brakes are arranged respectively thread-flow-downstream from said storage and supply devices.

13. The thread tension control apparatus in the loom of claim 2, wherein said first sensor is positioned so as to be in contact with the selected weft thread during insertion thereof, and said second sensor is positioned so as to be in contact with the selected weft thread during presentation thereof by said weft thread selector arrangement.

14. The thread tension control apparatus in the loom of claim 2, wherein said first sensor is a weft thread monitor stop motion device.

15. The thread tension control apparatus in the loom of claim 1, wherein said first sensor is a weft thread monitor stop motion device.

16. The thread tension control apparatus in the loom of claim 1, wherein said first sensor is positioned so as to be in contact with the selected weft thread during insertion thereof.

17. The thread tension control apparatus in the loom of claim 1, wherein the loom further includes a respective plurality of weft thread storage and supply devices to provide the plurality of weft threads, and wherein said weft thread brakes are arranged respectively thread-flow-downstream from said storage and supply devices.

18. The thread tension control apparatus in the loom of claim 1, wherein said control loop comprises an electronic control and comparison unit, a first conductor connecting a signal output of said first sensor to said unit, and respective further conductors connecting said unit respectively to said weft thread brakes.

19. The thread tension control apparatus in the loom of claim 1, wherein the loom is a gripper loom further having a gripper-type weft thread insertion member arranged to receive the selected weft thread presented by said weft thread selector arrangement, and a guide member arranged externally from said loom shed in guiding contact with said insertion member, and wherein said first sensor is mounted on said guide member.

20. The thread tension control apparatus in the loom of claim 19, wherein said first sensor is mounted on and extends upwardly from an end of said guide member closest to said loom shed.

* * * * *